United States Patent [19]

Kicherer et al.

[11] 4,260,977

[45] Apr. 7, 1981

[54] THERMOSTATIC SWITCH

[76] Inventors: Robert Kicherer, Im Bergfeld 33, 7134 Knittlingen; Manfred Schwarze, Rote-Tor-Str. 53, 7519 Oberderdingen, both of Fed. Rep. of Germany

[21] Appl. No.: 29,239

[22] Filed: Apr. 11, 1979

[30] Foreign Application Priority Data

Apr. 13, 1978 [DE] Fed. Rep. of Germany ..... 2815987

[51] Int. Cl.[3] ..... H01H 37/76; H01H 37/12

[52] U.S. Cl. ..... 337/318; 337/319

[58] Field of Search ..... 337/317, 318, 319, 320, 337/327, 329, 306, 121, 122

[56] References Cited

U.S. PATENT DOCUMENTS

| | | | |
|---|---|---|---|
| 2,855,486 | 10/1958 | Weber et al. | 337/318 |
| 3,096,420 | 7/1963 | Dills | 337/319 |
| 3,214,538 | 10/1965 | Tyler | 337/321 |
| 3,354,281 | 11/1967 | Durst et al. | 337/319 |
| 3,656,182 | 4/1972 | Staples | 337/327 |
| 4,160,225 | 7/1979 | Durst | 337/321 |

*Primary Examiner*—Harold Broome

*Attorney, Agent, or Firm*—Steele, Gould & Fried

[57] ABSTRACT

A thermostat, comprising: a metal casing; a snap switch having a snap spring disposed in the casing; a thermal expansion system, having an expansion member which acts on the snap spring, and having a setting element; an insulator arranged between two side parts of the casing, interconnecting the latter and forming one end face of the thermostat, and having fixed electrical contacts projecting therethrough; and, a contact bridge arranged on the snap spring, but electrically insulated therefrom, the contact bridge being engageable with the fixed contacts.

18 Claims, 4 Drawing Figures

THERMOSTATIC SWITCH

BACKGROUND OF THE INVENTION

1. Field of the Invention

The invention relates to the field of thermostats, and in particular, those activated by thermal expansion systems.

2. Description of Prior Art

Austrian Pat. No. 201,890 already discloses a thermal cut-out of this type having a cup-shaped insulating casing to which are fitted the fixed contacts. The snap switch is mounted together with the expansion member on a sheet metal cover screwed onto the insulating casing. As the snap spring does not participate in the current transmission, both the adjusting element and the expansion element can act on the snap switch without interposed insulation. As a result, the snap switch and in particular the snap spring can be optimised with respect to their mechanical switching functions, so that a construction with minimum switching hysteresis is possible. In particular, there is a possibility of mounting the snap switch exclusively in knife-edge supports, which would not otherwise be possible with higher current intensities due to the current connection to the snap spring. However, this thermal cut-out has a complicated and costly construction and assembly.

BRIEF SUMMARY OF THE INVENTION

It is an object of this invention to provide an improved thermostat, having a simpler, more space saving and robust construction.

These and other objects are accomplished by the thermostat described and claimed herein.

The construction of a thermostat according to this invention is particularly simple, being constructed solely of sheet metal parts, except for a connecting block and an insulator on the snap spring. This leads to such a compact construction that it is possible to provide a completely satisfactory thermostat whose switch member has a height and width of less than 20 mm.

BRIEF DESCRIPTION OF THE DRAWINGS

The invention is described in greater detail hereinafter relative to a non-limitative embodiment and with reference to the attached drawings, wherein.

DETAILED DESCRIPTION OF THE PREFERRED EMBODIMENTS

Figure 1:
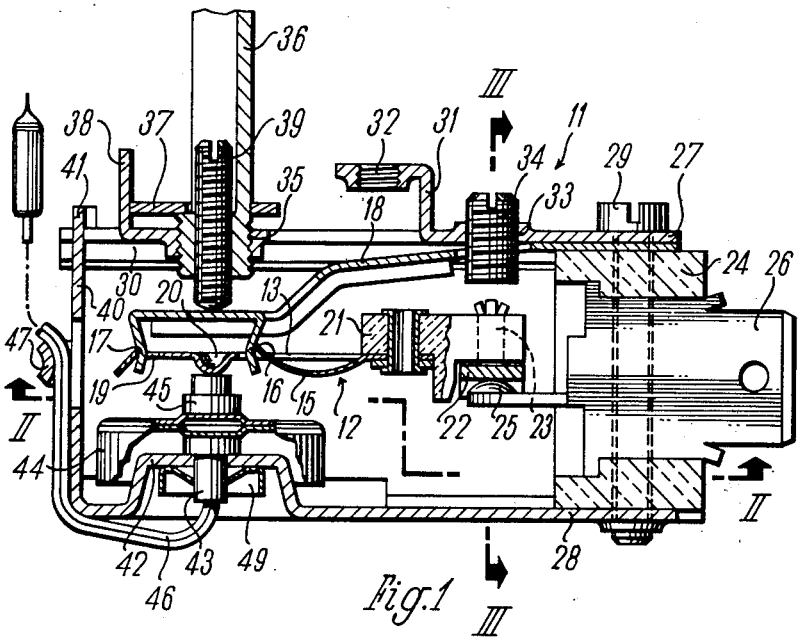
FIG. 1 an enlarged cross-section through the switch along line I—I of FIG. 2.
Figure 2:
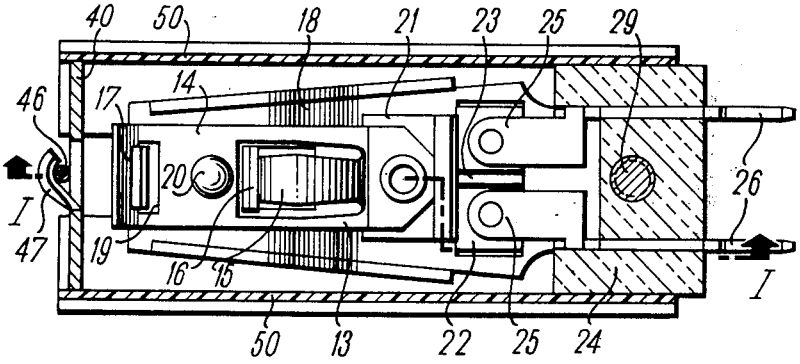
FIG. 2 a section along the line II—II of FIG. 1.
Figure 3:
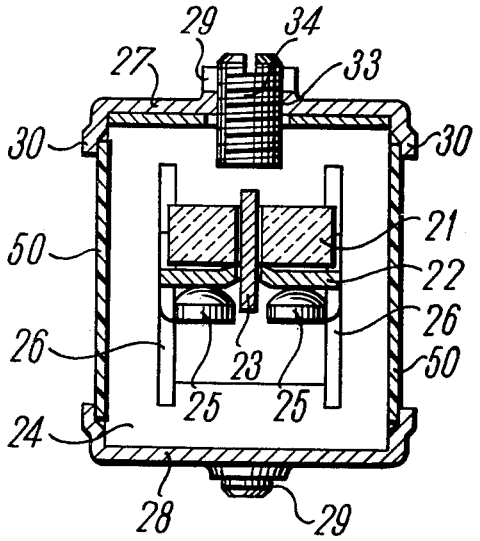
FIG. 3 a section along the line III—III of FIG. 1.

The thermostat 11 shown in FIGS. 1 to 3 has a snap switch 12 with a snap spring 13 and is constructed as a single-pole, single-throw switch. However, it is also possible to provide the thermostat with a multipole switch or a changeover switch.

Snap spring 13 comprises a strip-like base spring part 14 made from thin spring material from which is cut a spring tongue 15 by a U-shaped notch. The free end thereof and one end of the base spring part are supported in knife-edge support 16, 17 provided on a lever 18 arranged substantially parallel to the snap spring. The knife-edge support 17 at the end of the base spring part passes through a slot 19 therein, so that the supports point in opposite directions, thereby retaining the base spring part. An actuating pressure point 20 in the form of an impression in the base spring part is located between the two knife-edge supports 16, 17.

To the free end of snap spring 13 opposite to the knife-edge support 17 is riveted an insulator 21 having on its underside a contact bridge 22 fixed by a T-shaped rivet 23 with a slight clearance to the insulator 21. It extends at right angles to the extension of the snap spring and is insulated with respect thereto. The contact bridge 22 cooperates with two fixed contacts 25 arranged in juxtaposed manner in an insulator 24 and only bridges the contacts if the snap spring is in its lower on position.

The fixed contacts 25 are in each case fitted to one end of contact parts 26, formed in each case from a sheet metal strip projecting through slots in the rectangular insulator and forming at the end thereof which projects from the insulator and the thermostat a flat insertion tongue for electrical connection purposes.

Insulator 24 is braced by means of a screw 29 between two sheet metal side parts 27, 28. Side part 27 is shaped as a substantially flat sheet metal strip having in the edge area folds 30 and on which the L-shaped mounting plate 31 is cut out and bent downwards and carrying a fastening screw thread 32 in a spout drawn from the metal sheet. In the same way, a thread 33 is provided into which is screwed an adjusting screw 34 which cooperates with rivet 23 for fixing the contact spacing, i.e. the possibility of movement of the snap switch on switching over.

In another such spout is provided a setting thread 35 into which is screwed a setting spindle 36, whose lower area was once constructed as a screw spindle. The portion of the hollow setting spindle which projects vertically from the thermostat has a bevel for preventing the knob from turning. To the knob is fixed a stop member 37 which cooperates with an abutment on side part 27 constructed in the form of a bent out sheet metal tongue 38. Setting spindle 36 also has an internal thread into which is screwed an adjusting screw 39 for temperature adjustment purposes.

The end of adjusting screw 39 which projects inwards via the setting spindle 36 presses on the lever 18 in its free area carrying the supports 16, 17. The lever is secured by means of screw 29 between side part 27 and insulator 24, whereby it is reinforced in resilient manner at its end connected to the clamping point and in the remaining area by a fold. Consequently, lever 18 is pressed in leaf spring-like manner in the direction of adjusting screw 39 and is rotated by the latter during its movement and in particular during the movement of setting spindle 36. Thus, the position of the snap spring in the area of its supports and actuating point 20 is varied in accordance with the temperature adjustment and setting.

The operating side of thermostat 11 is covered by side part 27. The opposite side is covered by side part 28, which is also constructed in the form of a sheet metal plate reinforced by folds, but which at the end opposite to the connecting member or insulator 24 is bent in L-shaped manner and consequently covers the end face opposite to the connecting side. This L-shaped member 40 is at its free end connected to the side part 27 by turned sheet metal tongues 41 inserted through slots in said side part 27. Thus, side parts 27, 28 together with insulator 24 constructed as a rectangular and almost parallelepipedic body a stable frame surrounding and securing all parts of the thermostat.

Side part 28 has an inwardly directed dish-shaped impression 42 with a central bore through which projects a connecting part 43 of a hydraulic expansion member 44 and is fixed thereto by means of a slipped over spring clamping ring 49. The expansion member 44 comprises in per se known manner two cup-shaped, nested sheet metal shells welded to one another in the edge area and which bring about an expansion in the central area due to their elasticity which is aided by corrugations. The connecting part 43 is in turn fixed to the inside of its cup-shaped figure, said connecting part 43 being fixed to the side part 28, while to the other side a pressure plate 45 is secured by spot welding. A capillary tube 46 which connects the expansion member with a diagrammatically shown sensor projects into the connecting part 43 and is soldered into it. The capillary tube runs along the outside of side part 28 and is fixed to the L-shaped member 40 for tension relief purposes by means of a sheet metal tongue 47.

The casing or structure carrying the individual parts of the thermostat is small and compact and is mainly made from stamped metal parts. There are only two simple insulating parts made from a ceramic material such as steatite. The thermostat can easily and reliably be adjusted. The snap spring, on whose actuating pressure point 20 acts the pressure plate 45 is not endangered by overpressing because it is suspended in two knife-edge supports. The two longitudinal sides extending between side parts 27 and 28, i.e. the sides running in front of and behind the drawing plane and parallel thereto in FIG. 1, can be covered by small plates 50 of a thin insulating material secured by the folds of side parts 27, 28.

The thermostat according to the invention functions as follows In the off position the setting spindle which has a left-hand thread is screwed down and has pivoted lever 18 to such an extent that the snap spring is pressed over its actuating point 20 against pressure plate 45 and consequently the snap spring is pivoted into the off position not shown in FIG. 1 where rivet 23 enages on adjusting screw 34 and contacts 25 are separated from contact bridge 22. On switching on by turning the setting spindle 36 to the right, lever 18 is pivoted (raised) somewhat in the clockwise direction and moves the snap spring 13 away from pressure plate 45. As a result, snap spring 13 snaps into the on position shown in FIG. 1 in which the two contacts 25 are bridged by the contact bridge 22 and consequently there is a conductive connection between the two connecting parts 26. The limited mobility of contact bridge 22 ensures that both contacts 25 are reliably contacted. If as a result of heating the not shown sensor, expansion fluid is conveyed through the capillary tube 46 into expansion member 44, the latter expands and the pressure plate 45 is moved in the direction of the snap spring until, through corresponding pressure, said spring is again pivoted into the initially described off position. This is repeated a random number of times. Due to the advantageous construction of the snap spring the latter can have a very low hysteresis, so that temperature differences of a few degrees and consequently actuating paths at pressure point 20 of about a hundredth of a millimeter are sufficient to bring about connection and disconnection.

Numerous variants of the above embodiment are possible. Thus, for example, an expansion system in the form of a hydraulic member can be replaced by a preferably short and powerful bimetal, optionally with a bridge configuration with two supported ends and central force reduction, if the thermostat is to be directly arranged in the area to be scanned. In place of the screw spindle, it would also be possible to use a cam disk mounted on one side part if, for example, a non-linear setting characteristic is desired. The screw spindle makes it possible to arrange the central pressure plate of the expansion member, the actuation point and the application point of the screw spindle substantially on a single axis without requiring transmission ratios. In the case of a cam disk, a transmission ratio would be possible by correspondingly arranging or lengthening the lever 18. Of particular advantage is a construction in which the insulator 21 carrying contact bridge 22 is made from non-tracking plastics material injected round the end of the snap spring. It has a low weight, so that due to lower forces due to inertia, the snap spring can operate more rapidly.

Figure 4:
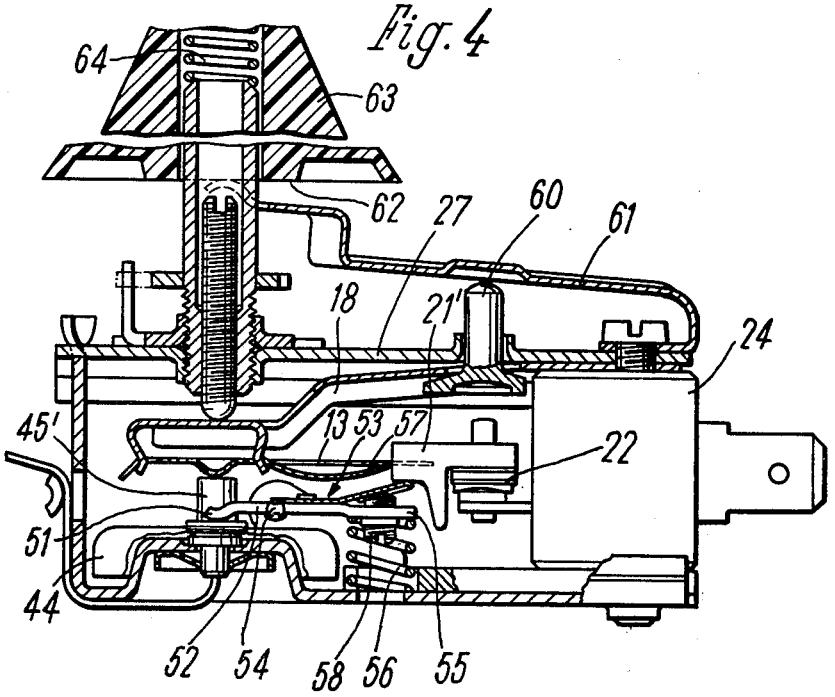
FIG. 4 a cross-section through a variant.

FIG. 4 shows a thermostat which coincides with that of FIGS. 1 to 3, except for the differences indicated hereinafter. The same parts carry the same reference numerals. Expansion member 44 has a pressure plate 45' with a band on which is supported a fork-shaped arm 51 of a double-armed lever of a disconnecting device mounted about an axis 54 under the tension of spring 56 acting on the other arm 55 of the lever. On lever 55 is provided an application part 57 in the form of a leaf spring which, by means of an adjusting screw 58, can be supported by lever arm 55. Insulator 21' carrying the contact bridge 22 comprises non-tracking plastics material injected round the free end of snap spring 13. It has such a low weight that due to lower forces due to inertia the snap spring can operate more rapidly.

The disconnecting device 53 is arranged in such a way that the application part 57 acts on insulator 21' and can keep the contacts open despite the snap spring loaded in the switching on direction if, as shown in FIG. 4, the expansion member contracts very considerably due to a leak in the expansion system (hydraulic sensor, capillary tube or expansion member), Thus, the switch is secured against damage to the expansion system (intrinsically safe). The disconnecting device 53 is independent of the snap spring and is actuated directly by the expansion member and forms an abutment for keeping the contacts open.

Opposite insulator 23 or the stop member provided thereon, there is a counter-abutment 60, but at such a large distance that the snap spring, when it jumps back into its off position due to the expansion of expansion member 44, engages the counter-abutment 60 and by contraction of the expansion member cannot be brought back into its on position. The snap spring has then jumped out of its snapping zone. For reconnection purposes, counter-abutment 60 is moved towards the snap spring. The counter-abutment which projects through a hole in the snap spring carrier 18 and side part 27 is mushroom-shaped and its stem projects out of the thermostat. A one-arm spring lever 61 fixed in the vicinity of insulator 24 is able to press by its central area onto the shaft of counter-abutment 60 if its free end, which in fork-like manner engages around the setting spindle, is pressed down by the band 62 of a knob 63 which is manually axially displaceable on the setting spindle counter to the tension of a spring 64. The thermostat according to FIG. 4 is not only intrinsically safe, but is also provided with a cut-out function which prevents automatic reconnection. Further, the cut-out temperature is adjustable.

Further still, the features of intrinsic safety and selection cut-out function can be used independently of one another. The spring lever 61 can also be omitted, reconnection then taking place by pressing on the shaft of counter-abutment 60. It is then for example necesary to open the casing, which may be desirable in that it ensures the elimination of a fault which has led to the indicated excess temperature.

The invention is not limited to the embodiments described and represented hereinbefore and various modifications can be made thereto without passing beyond the scope of the invention.

What is claimed is:

1. A thermostatic switch comprising:

a metal casing;

a snap switch disposed in the casing, the snap switch having a snap spring supported by a resiliently movable snap spring carrier running substantially parallel to the snap spring;

a thermal expansion system having an expansion member which acts on the snap spring;

a setting element for adjustably positioning the snap spring carrier relative to the expansion member;

an insulator forming one end face of the metal casing, supporting fixed electrical contacts projecting therethrough; and, an electrical contact bridge disposed on the snap spring but electrically insulated therefrom, the contact bridge cooperating with the fixed contacts.

2. A thermostatic switch according to claim 1, wherein one of the side parts is L-shaped, having a shorter member forming the other end face of the thermostat, the shorter member having an end placed on the other side part.

3. A thermostatic switch according to claim 2, wherein the side parts are sheet metal plates provided with folds, and the intermediate longitudinal sides are sealed by small insulating plates located behind the folds.

4. A thermostatic switch according to claim 1, wherein the expansion member is fixed to one of the side parts.

5. A thermostatic switch according to claim 1, wherein the expansion system further comprises an hydraulic sensor connected to the expansion member via a capillary tube, the expansion member acting directly and/or without transmission ratio on an actuating pressure point of the snap spring and having a central connecting portion into which the capillary tube centrally projects, and wherein the connecting portion projects through an opening of the L-shaped side part and is fixed thereto by a spring clamping ring.

6. A thermostatic switch according to claim 1, wherein the setting member is disposed in the side part which is not L-shaped and which faces the L-shaped side part carrying the expansion member and is a screw spindle screwed into a thread in the form of a spout.

7. A thermostatic switch according to claim 1, wherein the setting member carries a central adjusting screw and a mounted rotation limiting abutment.

8. A thermostatic switch according to claim 1, wherein the snap spring has a base spring part and a spring tongue, mounted in knife-edge supports.

9. A thermostatic switch according to claim 1, wherein the contact bridge is resiliently mounted on an insulator on the free and of the snap spring, and is fitted to a plastic insulator partially enclosing the free end of the snap spring.

10. A thermostatic switch according to claim 1, further comprising two knife-edge supports for the snap spring, the expansion member acting on an actuating point located between the two knife-edge supports.

11. A thermostatic switch according to claim 1 further comprising a disconnecting device for opening the switch in response to extreme contraction of the expansion member due to damage in the expansion system.

12. A thermostatic switch according to claim 11, wherein the disconnecting device acts on the end of the snap spring carrying the contact bridge.

13. A thermostatic switch according to claim 12, wherein the disconnecting device is a double-armed lever, having one arm supported under spring tension on the expansion member and another arm carrying an adjustable engagement part for moving the contact bridge.

14. A thermostatic switch according to claim 1, further comprising a counter-abutment for limiting movement of the free end of the snap spring away from the fixed contacts in the off position, there being a sufficiently great distance between the free end of the snap spring in the off position and a neutral snap-over position that the snap spring can not return to the on position after even a single disconnection.

15. A thermostatic switch according to claim 14, further comprising means for manually positioning the counter-abutment relative to the fixed contacts to reduce the distance necessary to bring about a reconnection, including a pivotally mounted, one-arm spring lever having a free end located adjacent the setting member and an axially adjustable knob which engages the free end of the one-arm lever.

16. A thermostatic switch according to claim 4, wherein the expansion member is fixed to the L-shaped side part.

17. A thermostatic switch comprising:

a metal casing;

a snap switch having a snap spring disposed in the casing;

a thermal expansion system having an expansion member which acts on the snap spring;

a setting element for adjustably positioning the snap spring relative to the expansion member;

an insulator forming one end face of the casing, supporting fixed electrical contacts projecting therethrough;

an electrical contact bridge arranged on the snap spring but electrically insulated therefrom, the contact bridge cooperating with the fixed contacts; and, means for disabling the thermostatic switch comprising a lever for moving the contact bridge relative to the fixed contacts upon extreme contraction of the expansion member, the lever having one arm supported by the expansion member, under spring tension, and another arm for engaging the contact bridge.

18. A thermostatic switch according to claim 17, further comprising a resiliently movable snap spring carrier running substantially parallel to the snap spring, supported on and movable away from the setting element.

* * * * *